US006093111A

United States Patent [19]

Senn

[11] Patent Number: 6,093,111

[45] Date of Patent: Jul. 25, 2000

[54] DIAGNOSTIC GOLF SWING TRAINING DEVICE

[76] Inventor: Chad Senn, 407 Colony Dr., Allen, Tex. 75013

[21] Appl. No.: 09/298,507

[22] Filed: Apr. 22, 1999

[51] Int. Cl.[7] ..... A63B 69/36

[52] U.S. Cl. ..... 473/277; 473/270

[58] Field of Search ..... 473/219, 266, 473/269, 270, 271, 277, 272, 409; 434/252

[56] References Cited

U.S. PATENT DOCUMENTS

| | | | |
|---|---|---|---|
| 3,079,152 | 2/1963 | Cushing | 473/277 |
| 3,623,733 | 11/1971 | Cavanaugh | 473/277 |
| 5,221,089 | 6/1993 | Barrett | 473/271 |
| 5,288,074 | 2/1994 | Scheurer | 473/271 |
| 5,762,565 | 6/1998 | Milam et al. | 473/271 |
| 5,916,037 | 6/1999 | Hill | 473/277 |

*Primary Examiner*—Kien T. Nguyen
*Attorney, Agent, or Firm*—Gardere & Wynne, L.L.P.; Lawrence R. Youst

[57] ABSTRACT

A diagnostic golf swing training device (10) for providing real time feedback to a golfer relating to the rotation of the golfer's hips and weight distribution during the golf swing is disclosed. The device (10) comprises a footplate (12) that is positioned beneath one of the feet of the golfer. A vertical support member (14) is coupled on its lower end (16) to the footplate (12). A hip plate (30) is coupled to the upper end (28) of the vertical support member (14). The hip plate (30) is adjustable such that it may be positioned adjacent to the hips of the golfer. During the golf swing, the footplate (12) provides real time feedback to the golfer by signaling excessive forward or rearward movement of the hips of the golfer if the hips of the golfer contacts the hip plate (30).

17 Claims, 4 Drawing Sheets

DIAGNOSTIC GOLF SWING TRAINING DEVICE

TECHNICAL FIELD OF THE INVENTION

This invention relates, in general, to the field of golf training devices and, in particular to, a diagnostic golf swing training device that provides real time feedback to the golfer relating to the proper rotation of the golfer's hips and weight distribution during the golf swing.

BACKGROUND OF THE INVENTION

Without limiting the scope of the invention, its background will be describe with reference to the swing a golf club as an example.

Golfers are continually seeking to improve their swing technique in order to maximize both the accuracy and the distance the golf ball travels after contact with the golf club. In the past, the typical golf swing involved throwing the hips forward in the direction that the golfer is attempting to drive the golf ball. It has been found, however, that the accuracy and the distance the golf ball travels after contact with the golf club is not based upon the forward movement of the hips, but rather it is the rotary motion of the hips that provides the coiled energy or torsional force required for precision of aim and distance of a shot.

In an optimal stroke, the hips simply rotate about the axis of the golfer's torso with slight movement of the hips as weight is transferred from the rearward foot to the forward foot. All joints and muscle movements responsible for club head speed, which represents the momentum and kinetic energy of the club head that is transferred to the golf ball, are related to hip rotation and weight transfer. Thus, in order to achieve an efficient golf swing that provides both accuracy and distance to the travel of the golf ball, the golfer must learn the correct hip rotation and weight transfer and weight distribution. In the past, the only way to learn this correct hip rotation was for the golfer to enlist the services of a golf instructor to obtain the necessary feedback on correcting or improving the golf swing.

A need has therefore arisen for a device and a method for training the golfer to use the proper hip rotation and weight distribution during the golf swing. A need has also arisen for such a device and method that provides feedback to the golfer with regard to proper hip rotation and weight distribution during the golf swing. Further, a need has arisen for such a device and method that provides feedback to the golfer without the need for the golfer to enlist the services of a golf instructor.

SUMMARY OF THE INVENTION

The present invention disclosed herein provides a device and a method for training the golfer to use the proper hip rotation and weight distribution during the golf swing. The device and method of the present invention provides feedback to the golfer with regard to proper hip rotation and weight distribution during the golf swing without requiring the golfer to enlist the services of a golf instructor.

The present invention comprises a diagnostic golf swing training device that provides real time feedback to the golfer relating to the rotation of the golfer's hips and proper weight transference during the golf swing. The device comprises a footplate that is positioned beneath either the forward foot or the rearward foot of the golfer. A vertical support member is attached at its lower end to the footplate. At its upper end, the vertical support member is coupled to a hip plate. The hip plate is adjustable to various heights and thicknesses so that it may be positioned adjacent to either the forward hip or the rearward hip of the golfer. In one embodiment of the present invention, the footplate may provide real time feedback to the forward foot of the golfer by signaling excessive forward movement of the hips of the golfer if the forward hip of the golfer contacts the hip plate. Alternatively, the footplate may provide realtime feedback to the rearward foot of the golfer by signaling excessive rearward movement of the hips during the back swing of the golfer if the rearward hip of the golfer contact the hip plate.

The vertical support member of the diagnostic golf swing training device of the present invention may comprise first and second sections that are moveable coupled together to allow height adjustment of the hip plate for proper positioning of the hip plate relative to the forward or rearward hip of the golfer. In one embodiment, the vertical support comprise a hollow outer sleeve having an alignment hole and an inner tube having a plurality of substantially equally spaced holes. The inner tube is slidably received within the hollow outer sleeve such that a pair of holes of the inner tube may be aligned with the pair of holes of the hollow outer sleeve. A pin is then inserted within the aligned holes to support the inner tube and allow proper positioning of the hip plate relative to the hips of the golfer. In a alternative embodiment, the adjustment of the hip plate may be achieved by sliding the hip plate along the vertical support member.

The hip plate of the diagnostic golf swing training device of the present invention may provide for unidirectional or bidirectional feedback to the golfer relating to the proper rotation of the golfer's hips and weight distribution during the golf swing. In the unidirectional embodiment, the hip plate may comprises a flat plate that is positioned adjacent to the forward or rearward hip of the golfer such that excessive sideways, i.e., forward or rearward movement of the hips of the golfer causes contact with the hip plate during the golf swing providing real time feedback to the forward or rearward foot of the golfer via the footplate. In the bidirectional embodiment, the hip plate may comprises an arcuate plate that not only provides feedback with regard to excessive forward or rearward movement of the hips, but also, provides feedback with regard to excessive backward movement of the hips of the golfer if the seat of the golfer contacts the hip plate.

The footplate of the diagnostic golf swing training device of the present invention may comprise a single plate that is positioned beneath and provides feedback to the entire foot. The footplate of the diagnostic golf swing training device of the present invention may alternatively comprise a first feedback pedal positioned beneath the ball of the foot and a second feedback pedal positioned beneath the middle of the foot. This embodiment is particulary suited for the bidirectional embodiment of the diagnostic golf swing training device of the present invention.

The diagnostic method for golf swing training of the present invention involves positioning the footplate beneath the forward or rearward foot of the golfer, adjustably positioning the hip plate adjacent to the forward or rearward hip of the golfer and signaling excessive forward or rearward to movement of the hips of the golfer if the forward or rearward hip of the golfer contacts the hip plate during the golf swing by providing real time feedback to the forward or rearward foot of the golfer with the footplate. The method may also include signaling excessive backward movement of the hips of the golfer if the seat of the golfer contacts the hip plate during the golf swing by providing real time feedback to the golfer with the footplate.

BRIEF DESCRIPTION OF THE DRAWINGS

For a more complete understanding of the present invention, including its features and advantages, reference is now made to the detailed description of the invention taken in conjunction with the accompanying drawings in which like numerals identify like parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and do not delimit the scope of the invention.

Figure 1A:
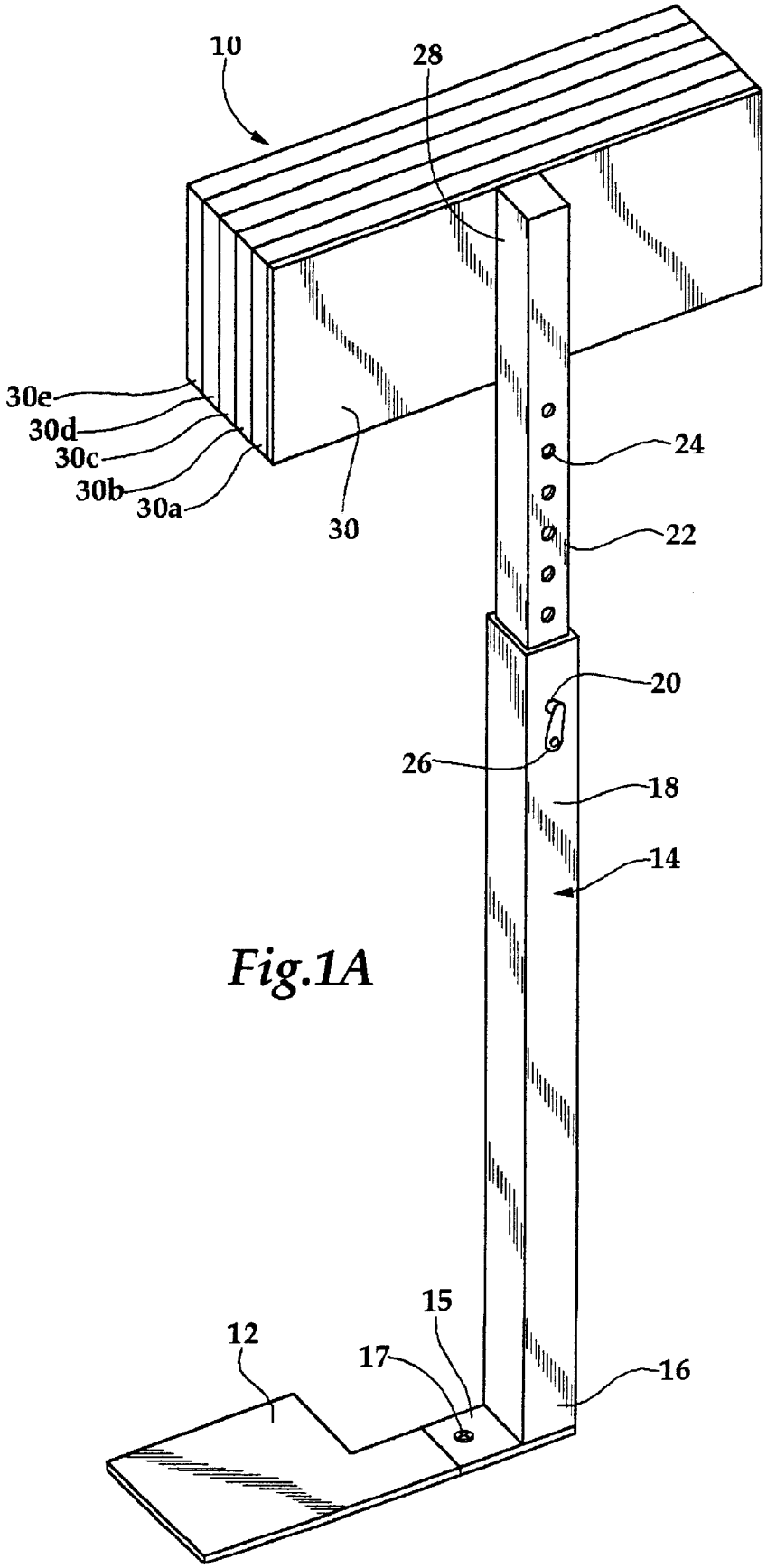
FIGS. 1A–1B are side elevation views of a diagnostic golf swing training device of the present invention.
Figure 1B:
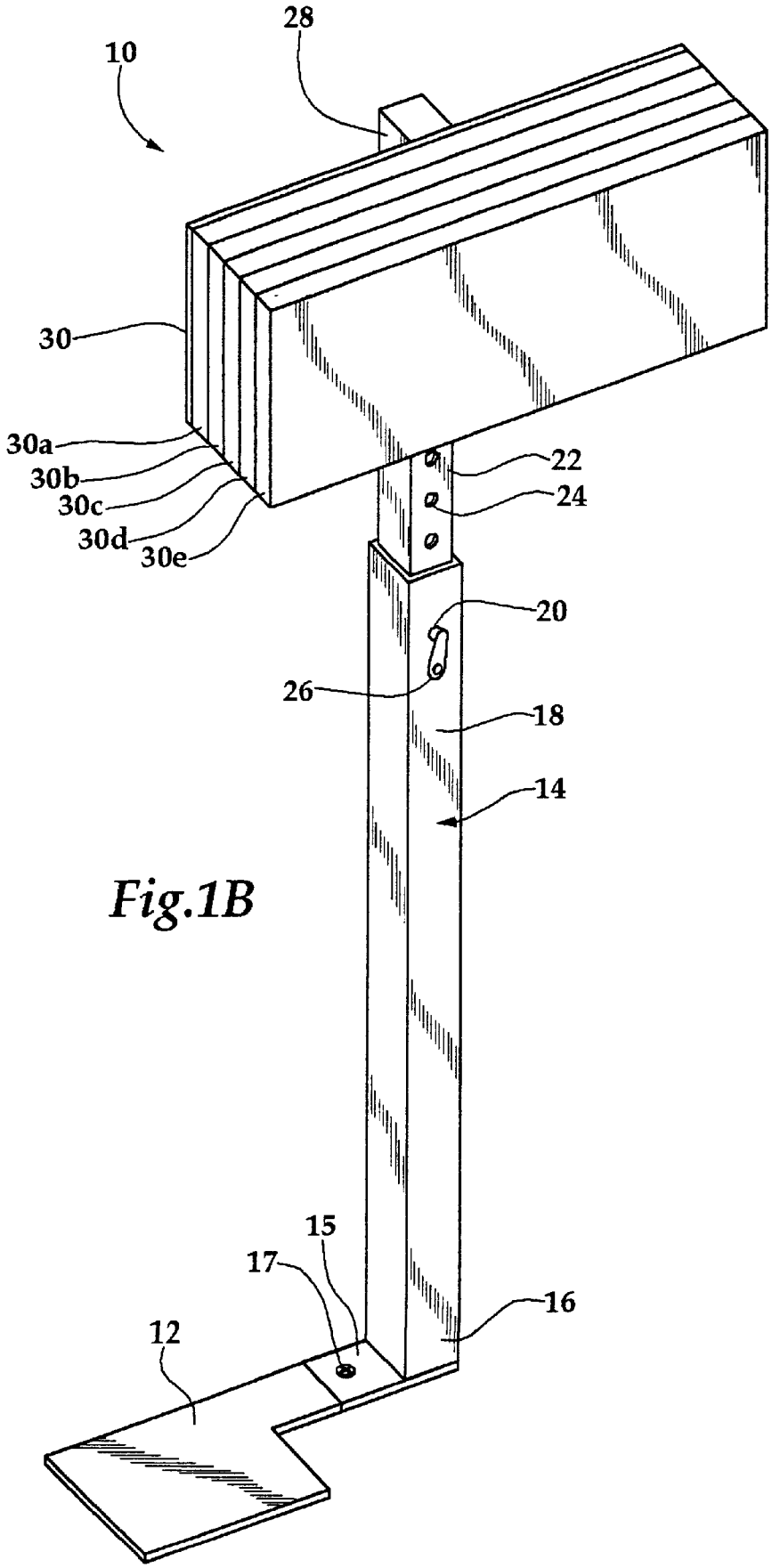

Referring to FIGS. 1A and 1B, therein is depicted a diagnostic golf swing training device for providing real time feedback to a golfer relating to the rotation of the golfer's hips and weight distribution during the golf swing that is generally designated 10. FIGS. 1A and 1B will be described together below as the component parts are identical. FIGS. 1A and 1B are mirror images of one another wherein the configuration of golf swing training device 10 shown in FIG. 1A could be a right hand configuration while the configuration shown in FIG. 1B could be a left handed configuration. Alternatively, the configuration shown in FIG. 1A could be a forward foot configuration while the configuration shown in FIG. 1B could be a rearward foot configuration as explained below.

Golf swing training device 10 includes a footplate 12. Footplate 12 is designed to be positioned beneath either the forward foot or the rearward foot of the golfer. Specifically, when footplate 12 is to be positioned beneath the forward foot, footplate 12 will be beneath the left foot of a right handed golfer or the right foot of a left handed golfer. In this configuration, the back foot of the golfer, right foot of a right handed golfer or the left foot of a left handed golfer, is not in contact with footplate 12 and is positioned on the ground independent from golf swing training device 10. Alternatively, when footplate 12 is to be positioned beneath the rearward foot, footplate 12 will be beneath the left foot of a left handed golfer or the right foot of a right handed golfer. In this configuration, the forward foot of the golfer, right foot of a left handed golfer or the left foot of a right handed golfer, is not in contact with footplate 12 and is positioned on the ground independent from golf swing training device 10.

Extending upwardly for footplate 12 is a vertical support member 14. Vertical support member 14 is coupled to footplate 12 via sleeve 15 at the lower end 16 of vertical support member 14. Vertical support member 14 may be coupled to sleeve 15 in a variety of suitable mechanical methods such as welding, bolting or the like. In the illustrated embodiment, footplate 12 is slidably received into sleeve 15 and is locked therein by fastener 17. Fastener 17 may be a threaded fastener, spring activated fastener or the like. Sleeve 15 and fastener 17 allow for simple conversion of golf swing training device 10 from the configuration shown in FIG. 1A to that shown in FIG. 1B, i.e., from a right handed to a left handed configuration or from a forward foot to a rearward foot configuration.

In the illustrated embodiment, vertical support member 14 includes a hollow outer sleeve 18. Hollow outer sleeve 18 has a pair of alignment holes 20, only one of which is pictured. Vertical support member 14 also includes an inner tube 22. Inner tube 22 is slidably receivable within hollow outer sleeve 18. Inner tube 22 has a plurality of substantially equally spaced pairs of holes 24. Holes 24 of inner tube 22 may be aligned with alignment holes 20 of hollow outer sleeve 18 to adjust the relative position of inner tube 22 relative to hollow outer sleeve 18. When inner tube 22 is positioned in the desired relationship with hollow outer sleeve 18, a pin 26 may be inserted through holes 24 of inner tube 22 and holes 20 of hollow outer sleeve 18 thereby supporting inner tube 22 within hollow outer sleeve 18.

Attached at the upper end 28 of vertical support member 14 is a hip plate 30. Hip plate 30 is attached to vertical support member 14 by suitable mechanical methods such as welding, bolting or the like. Hip plate 30 is adjusted to an elevation proximate the hips of the golfer. Hip plate 30 may include a plurality of hip plate sections 30*a*–30*e* to allow the thickness of hip plate 12 to be adjusted such that hip plate 30 may be positioned adjacent to the golfers hips. Hip plate sections 30*a*–30*e* may be attached together using a variety of mechanical methods such as snaps, magnets, loop and hook fasteners or the like. In the illustrated embodiment, the elevation of hip plate 30 is controlled by adjusting inner tube 22 relative to hollow outer sleeve 18 by removing pin 26, aligning the selected holes 24 of inner tube 22 with alignment holes 20 of hollow outer sleeve 18 and inserting pin 26 therethrough. Hip plate 30 and inner tube 22 Tray be positioned relative to outer sleeve 18 such that golf swing training device 10 may be in the configuration shown in FIG. 1A or FIG. 1B depending upon whether the golfer is right handed or left handed or depending upon whether the golfer desires to place footplate 12 beneath the forward or rearward foot.

When hip plate 30 is in its proper elevation and has the proper thickness, hip plate 30 may, for example, be positioned adjacent to the forward hip of the golfer. In this position and when the forward foot of the golfer is positioned upon footplate 12, the golfer receives real time feedback from footplate 12 to the forward foot of the golfer that signals excessive forward movement of the hips of the golfer if the forward hip of the golfer contacts hip plate 30 during the golf swing. As explained above, the accuracy and the distance the golf ball travels after contact with the golf club is based upon the rotary motion of the shoulders in relation to resistance of the hips that provides the coiled energy or torsional force required for precision of aim and distance of shot. Using the diagnostic golf swing training device 10 of the present invention provides a real time signal to the golfer that the mechanics of the golf swing are not consistent with the ideal swing.

As the optimal stroke involves a slight forward movement followed by rotation of the shoulders and hips as the weight of the golfer shifts from the rearward foot to the forward foot, the diagnostic golf swing training device 10 of the present invention signals the golfer that excessive sideways, i.e., forward or rearward, movement of the hips is occurring during the golf swing. Thus, using the diagnostic golf swing training device 10 of the present invention, the golfer learns to achieve an efficient golf swing that provides both accuracy and distance to the travel of the golf ball, without enlisting the services of a golf instructor to obtain the necessary feedback on correcting or improving the golf swing.

Specifically, the real time feedback received by the golfer is the lifting or tilting of the forward or rearward foot caused by footplate 12 when the golfer's hip contacts hip plate 30 during the golf swing. This real time feedback indicates to the golfer that excessive forward or rearward movement of the hips has occurred during the golf swing.

Figure 2:
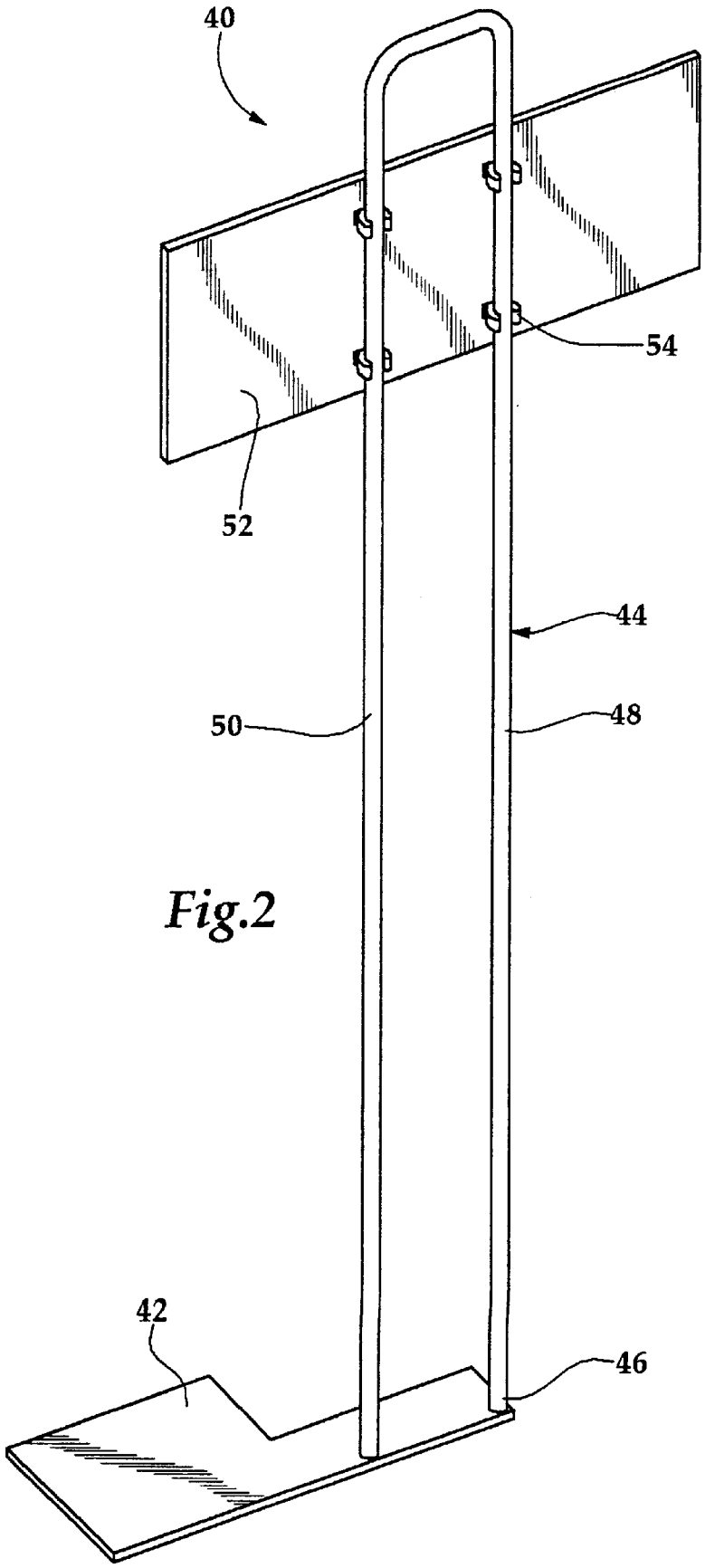
FIG. 2 is a side elevation view of an other embodiment of a diagnostic golf swing training device of the present invention.

Referring now to FIG. 2, therein is depicted a diagnostic golf swing training device for providing real time feedback to a golfer relating to the rotation of the golfer's hips and weight distribution during the golf swing that is generally designated 40. Golf swing training device 40 includes a footplate 42. Footplate 42 is designed to be positioned beneath one of the feet of the golfer as explained above with reference to FIG. 1. Extending upwardly for footplate 42 is a vertical support member 44. Vertical support member 44 is coupled to footplate 42 at its lower end 46. Vertical support member 44 may be coupled to footplate 42 in a variety of suitable mechanical methods such as welding, bolting or the like. In a preferred embodiment, footplate 42 is removeably attached to vertical support member 44 such that golf swing training device 40 may be converted from a right handed configuration to a left handed configuration or a forward foot configuration to a rearward foot configuration.

In the illustrated embodiment, vertical support member 44 includes a pair of vertical members 48, 50. Slidably attached to vertical support member 44 is a hip plate 52. Hip plate 52 is attached to vertical support member 44 using clamps 54 that releasably support hip plate 52 on vertical members 48, 50. Hip plate 52 is adjusted to an elevation proximate the lips of the golfer by sliding hip plate 52 along vertical members 48, 50 or by removing hip plate 52 from and replacing hip plate 52 on vertical members 48, 50. Hip plate 52 may be placed on either side of vertical members 48, 50 to allow conversion of golf swing training device 40 for left or right handed golfers or forward foot verses rearward foot positioning. Even though hip plate 52 is depicted as a single member, it will be understood by those skilled in the art that hip plate 52 may alternatively include a plurality of hip plate sections like those described with reference to FIG. 1.

When hip plate 52 is in its proper elevation and has the proper thickness, hip plate 52 may, for example, be positioned adjacent to the forward hip of the golfer. In this position and when the forward foot of the golfer is positioned upon footplate 42, the golfer receives real time feedback from footplate 42 to the forward foot of the golfer that signals excessive forward movement of the hips of the golfer if the forward hip of the golfer contacts hip plate 52 during the golf swing. Alternatively, footplate 42 may be placed beneath the rearward foot of the golfer to signal excessive rearward movement of the hips of the golfer if the rearward hip contacts hip plate 52 during the back swing. Thus, using the diagnostic golf swing training device 40 of the present invention, the golfer learns to achieve an efficient golf swing that provides both accuracy and distance to the travel of the golf ball, without enlisting the services of a golf instructor to obtain the necessary feedback on correcting or improving the golf swing.

Specifically, the real time feedback received by the golfer is the lifting or tilting of the foot beneath footplate 42 when the golfer's hip contacts hip plate 52 during the golf swing. This contact indicates excessive forward or excessive rearward movement of the hips during the golf swing.

Figure 3:
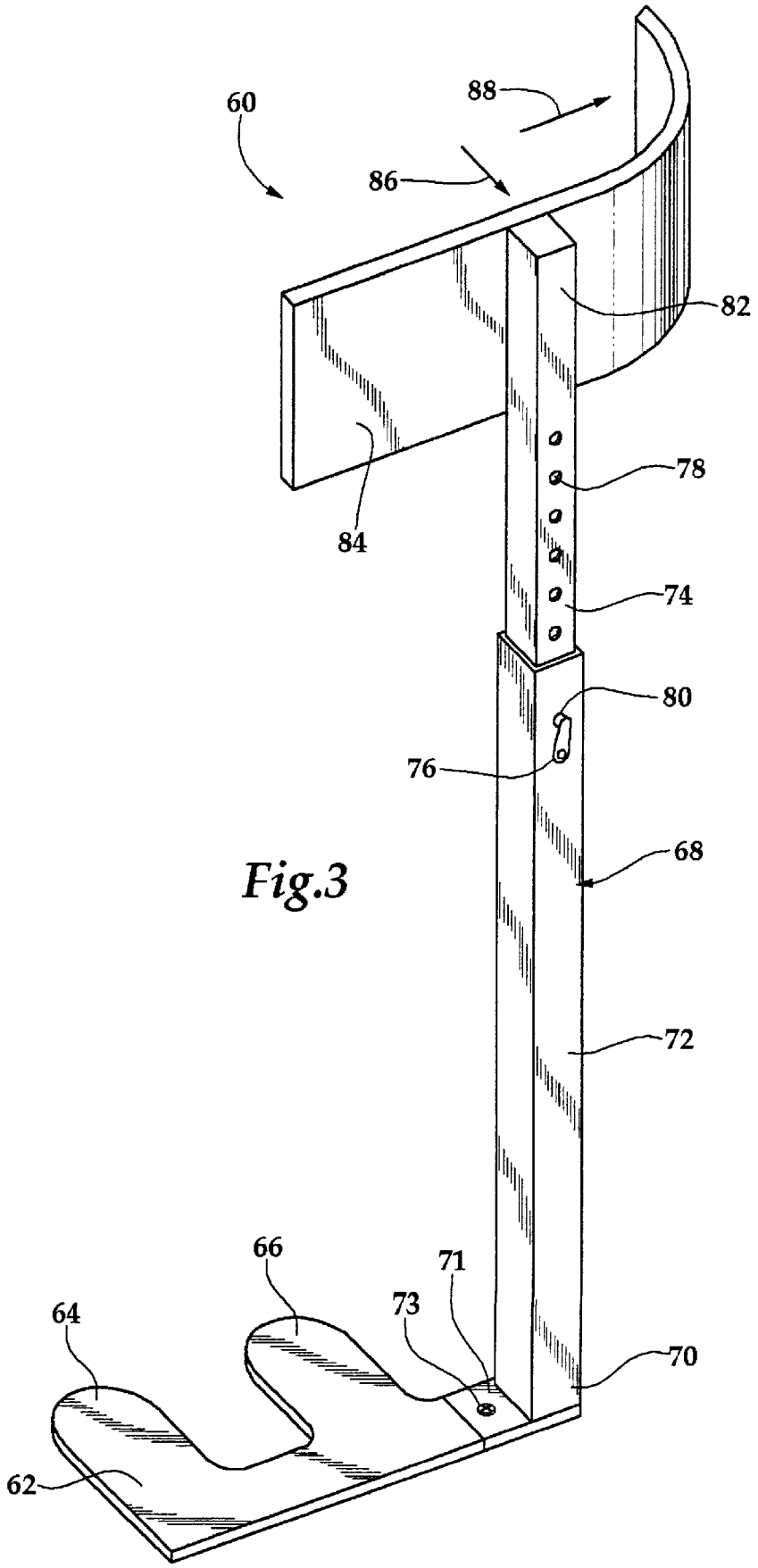
FIG. 3 is a side elevation view of a bidirectional embodiment of a diagnostic golf swing training device of the present invention.

Referring next to FIG. 3, therein is depicted an other embodiment of a diagnostic golf swing training device for providing real time feedback to a golfer relating to the rotation of the golfer's hips and weight distribution during the golf swing that is generally designated 60. Golf swing training device 60 includes a footplate 62. Footplate 62 includes a pair of pedals 64, 66. Footplate 62 is designed to be positioned beneath one of the feet of the golfer such that pedal 64 is positioned under the ball of the foot and pedal 66 is positioned under the middle of the foot. The utility of this design will be explained in more detail below.

Extending upwardly for footplate 62 is a vertical support member 68. Vertical support member 68 is coupled to footplate 68 via sleeve 71 at the lower end 70 of vertical support member 68. Vertical support member 68 may be coupled to sleeve 71 in a variety of suitable mechanical methods such as welding, bolting or the like. As with the embodiment discussed with reference to FIG. 1, footplate 62 is slideably received into sleeve 71 and secured therein by fastener 73 to allow conversion from a left handed golf swing training device 60 to a right handed golf swing training device 60 or from a rearward foot golf swing training device 60 to a forward foot golf swing training device 60. In the illustrated embodiment, vertical support member 68 includes a hollow outer sleeve 72 and an inner tube 74 that operate in the manner described above with reference to hollow outer sleeve 18 and inner tube 22 of FIG. 1. As such, the when inner tube 74 is positioned in the desired relationship with hollow outer sleeve 72, a pin 76 may be inserted through holes 78 of inner tube 74 and holes 80 of hollow outer sleeve 68 thereby supporting inner tube 74 within hollow outer sleeve 72.

Attached at the upper end 82 of vertical support member 68 is a hip plate 84. Hip plate 84 is attached to vertical support member 68 by suitable mechanical methods such as welding, bolting or the like. Hip plate 84 is adjusted to an elevation proximate the hips of the golfer by adjusting inner tube 74 relative to hollow outer sleeve 68. Hip plate 84 may include multiple hip plate sections (not pictured) to adjust the thickness of hip plate 84.

Using this embodiment of hip plate 84 allows for bidirectional diagnostic golf swing training. This is achieved by the unique arcuate shape of hip plate 84. In this embodiment of the present invention, hip plate 84 is positioned adjacent to, not only, a hip of the golfer, but also, adjacent to the seat of the golfer. Thus, when the hip plate 84 is positioned adjacent to the forward hip and when the forward foot of the golfer is positioned upon footplate 62, the golfer receives real time feedback from footplate 62 signaling both excessive forward hip movement and excessive backward hip movement.

Specifically, as indicated by arrow 86, during excessive forward movement of the hips of the golfer, when the forward hip of the golfer contacts hip plate 84, the forward foot of the golfer receives a signal from footplate 62. In addition, as indicated by arrow 88, during excessive backward movement of the hips of the golfer, when the seat of the golfer contacts hip plate 84, the forward foot of the golfer receives a signal from footplate 62. Both the excessive forward and the excessive backward movement of the hips adversely effect the accuracy and the distance the golf ball travels after contact with the golf club. Likewise, when footplate 62 is configured for and positioned beneath the rearward foot of the golfer, both excessive rearward and excessive backward movement of the hips is signaled to the golfer via footplate 62.

Using this embodiment of the diagnostic golf swing training device 60 of the present invention provides a real time signal to the golfer indicating both excessive forward or rearward movement of the hips and excessive backward movement of the hips during the golf swing that are not consistent with the ideal swing. For example, when footplate 62 is placed under the front foot, the real time feedback received by the golfer during excess forward movement is the lifting or tilting of the front foot caused by both pedal 64 under the ball of the golfer's front foot and pedal 66 under the middle of the golfer's front foot. Similarly, the real time feedback received by the golfer during excess backward movement is the lifting or tilting of the front foot caused by pedal 64 under the ball of the golfer's front foot. Alternatively, when footplate 62 is placed under the rearward foot, the real time feedback received by the golfer during excess rearward movement is the lifting or tilting of the rearward foot caused by both pedal 64 under the ball of the golfer's rearward foot and pedal 66 under the middle of the golfer's rearward foot. Similarly, the real time feedback received by the golfer during excess backward movement is the lifting or tilting of the rearward foot caused by pedal 64 under the ball of the golfer's rearward foot. Thus, in either configuration, the golfer receives bidirectional diagnostic golf swing training using diagnostic golf swing training device 60 of the present invention which utilizes the arcuate hip plate 84 and footplate 62 including pedals 64 and 66.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is, therefore, intended that the appended claims encompass any such modifications or embodiments.

What is claimed is:

1. A diagnostic golf swing training device for providing real time feedback to a golfer relating to the golf swing comprising:

a footplate operably positionable beneath a first foot of the golfer, the footplate having a first feedback pedal operably positionable beneath the ball of the first foot and a second feedback pedal operable positionable beneath the middle of the first foot;

a vertical support member having a first end and a second end, the first end of the vertical support member coupled to the footplate; and a hip plate coupled to the second end of the vertical support member, the hip plate adjustably positionable adjacent to a first hip of the golfer, whereby the footplate provides real time feedback to the first foot of the golfer signaling excessive sideways movement of the hips in a first direction if the first hip of the golfer contacts the hip plate during the golf swing.

2. The diagnostic golf swing training device as recited in claim 1 wherein the vertical support member further comprises first and second sections moveably coupled together to allow adjustment of the hip plate for proper positioning of the hip plate relative to the first hip of the golfer.

3. The diagnostic golf swing training device as recited in claim 1 wherein the first foot is the forward foot of the golfer and wherein the footplate provides real time feedback to the forward foot of the golfer signaling excessive forward movement of the hips of the golfer if the forward hip of the golfer contacts the hip plate during the golf swing.

4. The diagnostic golf swing training device as recited in claim 1 wherein the first foot is the rearward foot of the golfer and wherein the footplate provides real time feedback to the rearward foot signaling excessive rearward movement of the hips of the golfer if the rearward hip of the golfer contacts the hip plate during the golf swing.

5. The diagnostic golf swing training device as recited in claim 1 wherein the vertical support further comprises a pair of vertical members.

6. The diagnostic golf swing training device as recited in claim 5 wherein the hip plate is slidably attachable to the vertical members.

7. The diagnostic golf swing training device as recited in claim 1 wherein the hip plate further comprises a flat plate.

8. The diagnostic golf swing training device as recited in claim 1 wherein the hip plate further comprises an arcuate plate.

9. A bidirectional diagnostic golf swing training device for providing real time feedback to a golfer relating to the golf swing comprising:

a footplate operably positionable beneath a first foot of the golfer, the footplate having a first feedback pedal operably positionable beneath the ball of the first foot and a second feedback pedal operable positionable beneath the middle of the first foot;

a vertical support member having a first end and a second end, the first end of the vertical support member coupled to the footplate; and a hip plate coupled to the second end of the vertical support member, the hip plate adjustably positionable adjacent to a first hip of the golfer, whereby the footplate provides real time feedback to the first foot of the golfer signaling excessive sideways movement of the hips in a first direction if the first hip of the golfer contacts the hip plate during the golf swing and signaling excessive backward movement of the hips of the golfer if the seat of the golfer contacts the hip plate during the golf swing.

10. The bidirectional diagnostic golf swing training device as recited in claim 9 wherein the first foot is the forward foot of the golfer and wherein the footplate provides real time feedback to the forward foot of the golfer signaling excessive forward movement of the hips of the golfer if the forward hip of the golfer contacts the hip plate during the golf swing.

11. The bidirectional diagnostic golf swing training device as recited in claim 9 wherein the first foot is the rearward foot of the golfer and wherein the footplate provides real time feedback to the rearward foot signaling excessive rearward movement of the hips of the golfer if the rearward hip of the golfer contacts the hip plate during the golf swing.

12. The diagnostic golf swing training device as recited in claim 9 wherein the vertical support further comprises a pair of vertical members.

13. The bidirectional diagnostic golf swing training device as recited in claim 9 wherein the hip plate further comprises an arcuate plate.

14. A diagnostic method for golf swing training comprising:

positioning a footplate beneath a first foot of a golfer, the footplate having a first feedback pedal operably positionable beneath the ball of the first foot and a second feedback pedal operable positionable beneath the middle of the first foot;

adjustably positioning a hip plate adjacent to a first hip of the golfer, the hip plate being supported by a vertical support member extending between the hip plate and the footplate; and signaling excessive sideways movement of the hips in a first direction if the first hip of the golfer contacts the hip plate during the golf swing by providing real time feedback to the first foot of the golfer with the footplate.

15. The method as recited in claim 14 further comprising signaling excessive backward movement of the hips of the golfer if the seat of the golfer contacts the hip plate during the golf swing by providing real time feedback to the first foot of the golfer with the footplate.

16. The method as recited in claim 14 wherein the step of positioning a footplate beneath a first foot of a golfer further comprises positioning a footplate beneath the forward of the golfer such that the footplate provides real time feedback to the forward foot of the golfer signaling excessive forward movement of the hips of the golfer if the forward hip of the golfer contacts the hip plate during the golf swing.

17. The method as recited in claim 14 wherein the step of positioning a footplate beneath a first foot of a golfer further comprises positioning a footplate beneath the rearward foot of the golfer such that the footplate provides real time feedback to the rearward foot signaling excessive rearward movement of the hips of the golfer if the rearward hip of the golfer contacts the hip plate during the golf swing.

* * * * *